United States Patent [19]

Leupold

[11] Patent Number: 4,859,976

[45] Date of Patent: Aug. 22, 1989

[54] PERIODIC PERMANENT MAGNET STRUCTURES

[75] Inventor: Herbert A. Leupold, Eatontown, N.J.

[73] Assignee: The United States of America as represented by the Secretary of The Army, Washington, D.C.

[21] Appl. No.: 326,715

[22] Filed: Mar. 17, 1989

[51] Int. Cl.[4] ..... H01F 7/02

[52] U.S. Cl. ..... 335/306; 335/210

[58] Field of Search ..... 335/210, 212, 211, 301, 335/304, 306

[56] References Cited

U.S. PATENT DOCUMENTS 4,764,743 8/1988 Leupold et al. ..... 335/212 X 4,800,353 1/1989 Csonka et al. ..... 335/210

*Primary Examiner*—George Harris

*Attorney, Agent, or Firm*—Michael J. Zelenka; John K. Mullarney

[57] ABSTRACT

A periodic permanent magnet stack comprises a plurality of aligned, juxtaposed, hollow hemispherical flux sources each of which produces a uniform high-field in its hemispherical central cavity. The magnetic field orientations in the central cavities are axially directed and alternate or reverse in direction from hemisphere to hemisphere. An axial bore hole through the stack provides a continuous channel or path through which a beam of charged particles will travel.

7 Claims, 2 Drawing Sheets

PERIODIC PERMANENT MAGNET STRUCTURES

The invention described herein may be manufactured, used, and licensed by or for the Government for governmental purposes without the payment to me of any royalties thereon.

TECHNICAL FIELD

The present invention relates to high-field periodic permanent magnet structures for use in microwave/millimeter wave devices such as traveling wave tubes (TWTs).

BACKGROUND OF THE INVENTION

Both electromagnets and permanent magnets have been used to manipulate beams of charged particles. In traveling wave tubes, for example, magnets have been arranged around the channel through which the beam travels to focus the stream of electrons; that is, to reduce the tendency of the electrons to repel each other and spread out. Various configurations of permanent magnets (and pole pieces) have been tried in an attempt to increase the focusing effect while minimizing the weight and volume of the resulting device. In conventional traveling wave tubes, permanent magnets are typically arranged in a sequence of alternating magnetization, either parallel to, or anti-parallel to, the direction of the electron flow. The magnets (and pole pieces) are usually annular in shape and their axes are aligned with the path of the electron beam. Pole pieces constructed of ferromagnetic material such as electrolytic iron are often placed between the magnets and provide a path through which magnetic flux from the magnets may be directed into the working space along the axis of the traveling wave tube in order to influence the beam in the desired manner. The patent to Clarke, U.S. Pat. No. 4,731,598, issued Mar. 15, 1988, illustrates typical prior art, periodic permanent magnetic (PPM) structures.

One of the critical problems confronting those who develop magnetic structures used to contain or manipulate beams or charged particles has been how to more efficiently utilize the permanent magnet materials which make up the structure(s). Some specific problems include: how to maximize the strength of the magnetic field along the path of the charged particle beam without significantly increasing the mass of the magnetic structure; how to improve performance (e.g., output power); and how to increase the useful life of the TWTs. The present invention addresses these problems, and others.

The above-noted problems were also addressed in the co-pending patent application Ser. No. 213,970, filed July 1, 1988, which is incorporated by reference herein. In this co-pending application there is disclosed a periodic permanent magnet (PPM) structure that comprises a series of hollow spherical flux source (HSFS) or "magic spheres" placed tangent to each other in pearl string fashion. Axial bore holes through the magnetic poles of the spheres are coaxially aligned to form with spherical central cavities a continuous channel or path through which a beam of charged particles will travel. In any given magic sphere the magnetic field orientation in the axial bore hole is the reverse of that in the central cavity. Thus, the desirable characteristic of alternating magnetization in a PPM stack is fully realized in a string of coaxially aligned magic spheres. This HSFS PPM stack offers focusing fields of about 10 kOe. This is substantially greater than the approximately 6 kOe theretofore obtained in prior art PPM structures.

SUMMARY OF THE INVENTION

The present invention offers focusing fields equal to that of a HSFS stack (10 kOe) and, because it reduces the (magnetic field) period, substantially higher frequency TWT radiation sources can be constructed. Also, the invention results in lower internal operating temperatures in the PPM stack and therefore higher magnetic fields, better beam focusing, more efficient tube operation and longer tube life can be realized.

The present invention makes advantageous use of the hollow hemispherical flux source (HHFS) or "magic igloo" disclosed in the co-pending application of the present inventor, Ser. No. 199,504, filed May 27, 1988, which is incorporated by reference herein. The magic igloo comprises half a magic sphere placed on a planar sheet of high saturation, high permeability material. The magnetic "anti-mirror" image of the hemispheric structure in the permeable plane makes the hemispheric central cavity appear (magnetically) exactly as if a complete magic sphere were its source. For TWT applications, an axial bore hole through both the hemispherical magnetic shell and through the permeable plane is necessary.

Briefly and in accordance with the present invention, each of the spheres of a HSFS stack is divided by a plate of permeable material and the polarities of alternate hemispheres are reversed. This results in an axial field period that is half that of the HSFS stack and so higher frequency TWT operation can be realized. The resultant PPM stack comprises a series of aligned juxtaposed magic igloos wherein the magnetic field orientations in the central cavities alternate or reverse in direction from igloo to igloo. An axial bore hole through the hemispheric magnetic shells and permeable plates provides a continuous channel or path through which a beam of charged particles will travel.

BRIEF DESCRIPTION OF THE DRAWINGS

The invention will be more fully appreciated from the following detailed description when the same is considered in connection with the accompanying drawings in which.

DETAILED DESCRIPTION

Figure 1:
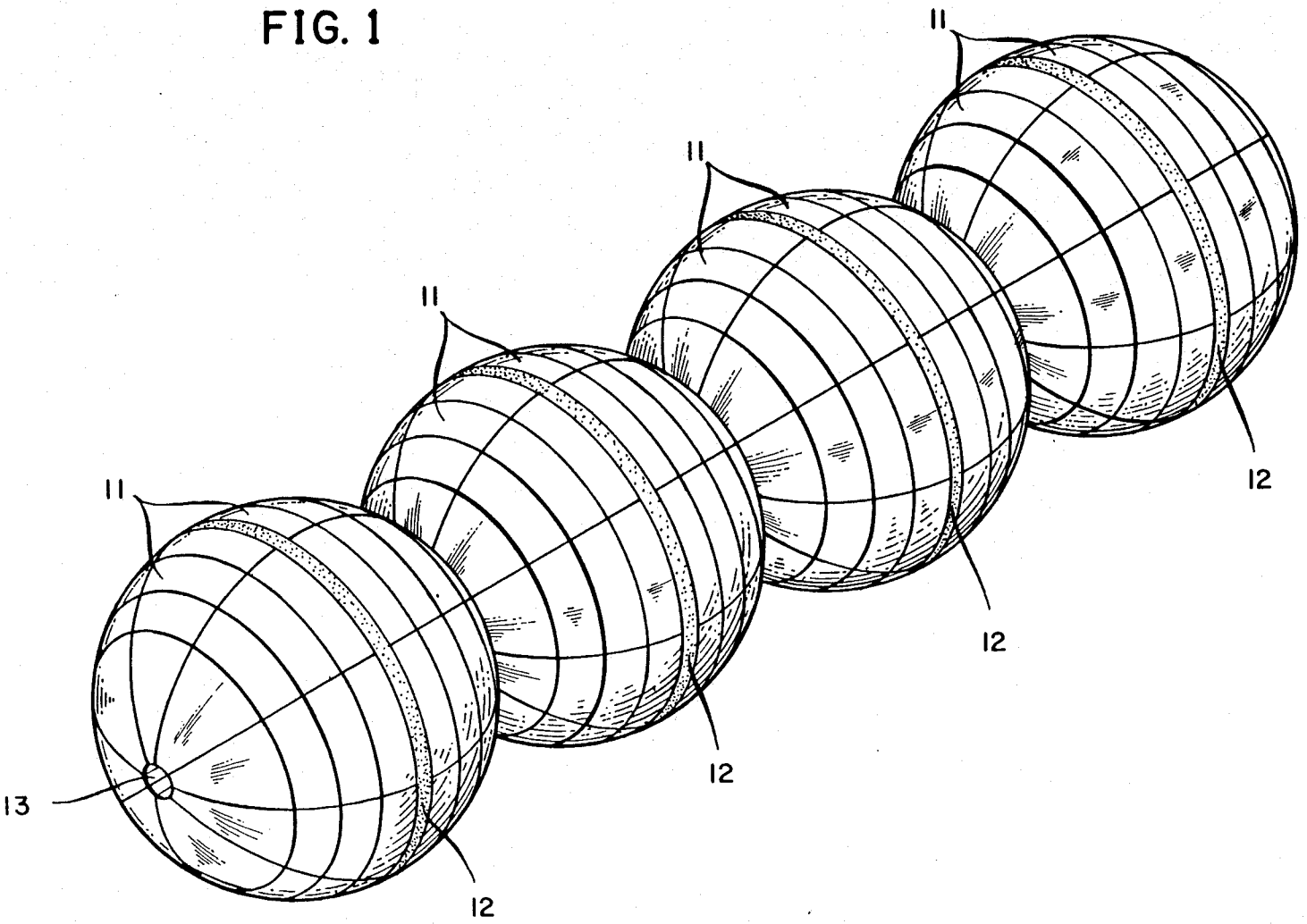
FIG. 1 illustrates a short series of coaxially aligned magic igloos farming a PPM structure in accordance with the present invention.

The periodic permanent magnet structure of the present invention makes advantageous use of a new and novel permanent magnet configuration, i.e., the magic igloo. FIG. 1 shows a series of eight coaxially aligned magic igloos 11. For TWT purposes upwards of 10 or more such igloos would be used to make up the PPM structure. However, it is to be understood that the principles of the present invention are in no way limited to any particular number of magic igloos utilized to make-up a PPM structure and different numbers of igloos may be used in different applications. The magic igloos are alike, and each comprises half a magnetic sphere or a hemisphere 11 placed on a planar sheet 12 of high saturation, high permeability material (e.g., one of the soft ferromagnets). Each magic igloo has a hemispherical central cavity (not shown in FIG. 1) and an axial bore hole 13 through the magnetic pole of the hemispheric magnetic shell and through the permeable plate. The bore holes of the magic igloos are coaxially aligned so as to provide a continuous channel or path through the HHFS stack. In a TWT the beam of charged particles (i.e., electrons) from the electron gun will travel through this channel on its way to the collector. The periodic permanent HHFS stack serves to focus tightly the stream of charged particles.

As will be more evident hereinafter, the magnetic field orientation in each axial bore hole is the reverse of that in its respective adjacent cavity. Accordingly, the desirable characteristic of continually alternating magnetization in a PPM stack is fully realized in the series of magic igloos. That is, along the aforementioned channel or particle beam path the direction of the focusing magnetic field alternates or reverses in direction.

It is perhaps of advantage at this point to briefly describe the magic igloo itself. For a more detailed description of the same reference may be had to the above-noted co-pending application of H. Leupold, the present inventor. The magic igloo is a hollow hemispheric flux source that provides a uniform high-field in its hemispheric central cavity. The hollow hemisphere is comprised of magnetic material and its magnetization is azimuthally symmetrical. The magnetic orientation ($\alpha$) in the hemispherical permanent magnet shell is related to the polar angle ($\theta$);$\alpha=2\theta$. The value $\alpha$ is the magnetization angle with respect to the polar axis. As indicated previously, a magic igloo will typically be provided with an axial bore hole through its magnetic pole and/or through its ferromagnetic plate. In TWT's holes through both plate and magnet are necessary for a continuous beam path. The magnetic hemispherical shell is placed on a planar sheet of permeable material. The magnetic image of the hemispheric structure in the permeable plane makes the hemispheric central cavity appear (magnetically) exactly as if a complete magic sphere were its source.

Since it is not feasible to construct an ideal magic hemisphere that consists of a unitary, hollow hemispherical body of magnetic material, a segmented approximation such as shown in the hemispheres of FIG. 1 is utilized. Fortunately, even with as few as 32 segments per hemisphere, more than 90 percent of the field of an ideal structure is obtainable. However, it is to be understood, that the magic igloos used in accordance with the present invention might be comprised of a fewer or larger number of segments. The greater the number of segments the closer the approximation to the ideal case.

Figure 2:
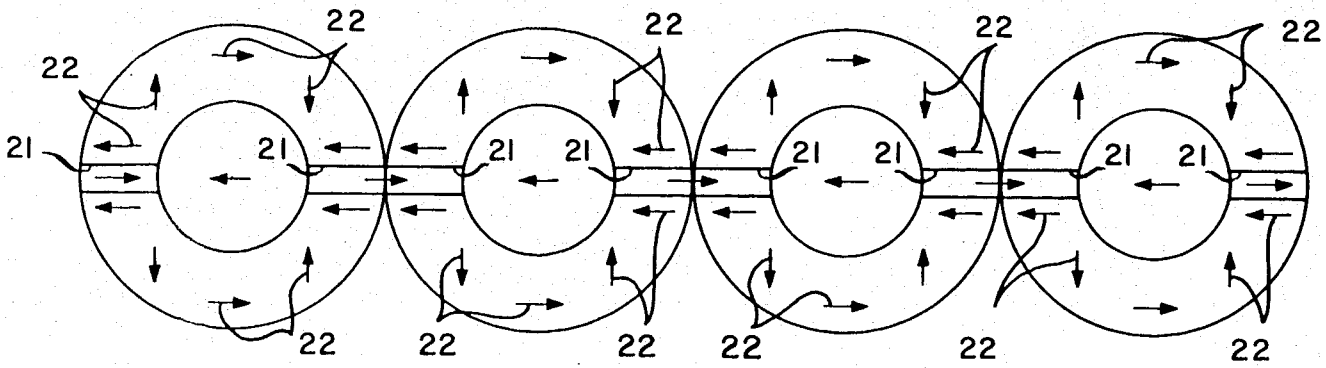
FIG. 2 is a cross section display of four magic spheres that are field aligned.

FIG. 2 is a cross section view of four magic spheres which are coaxially aligned and field aligned, i.e., the magnetic field orientations in the central cavities are in the same direction. And, the magnetic field orientation in the coaxial bore holes 21 is the reverse of that in the cavities. The arrows 22 depict the magnetic orientation in the magnet shell(s). In the spherical pearl string embodiment shown in FIG. 2, the inner (cavity) radius and the wall or shell thickness are the same (e.g., 2 cm).

The string of magic spheres depicted in FIG. 2 can produce high, "flat" focusing fields in the spherical central cavities and in the coaxial bore holes. For a good field distribution, the spherical cavity diameter(s) must be not less than about four times the diameter of the bore hole(s). And, if a given electron beam diameter is required, the axial bore hole(s) 21 must be at least as large to accommodate it. Accordingly, the spherical cavities must be about four times the beam diameter, at least. In the FIG. 2 spherical string, the period of the magnetic field is twice the spherical cavity diameter and therefore the field period is eight times the beam (or bore) diameter.

The present invention achieves a significant reduction in the (magnetic field) period to bore ratio; specifically, the period to bore ratio is reduced from eight to four. As a consequence, higher frequency TWT radiation sources can be constructed.

Figure 3:
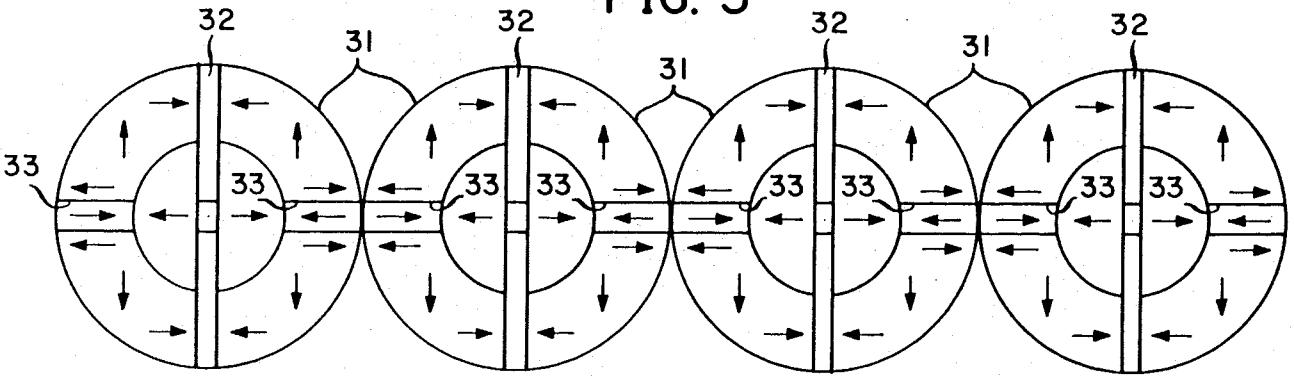
FIG. 3 is a cross section display of a short series of coaxially aligned magic igloos according to the invention.

Turning now to FIG. 3, the magic spheres of FIG. 2 are, the effect, divided by plates 32 of permeable material and the polarities of alternate hemispheres are reversed. That is, the abbreviated PPM stack shown in FIG. 3 comprises a series of coaxially aligned, juxtaposed magic igloos 31 wherein the magnetic field orientations in the central cavities alternate or reverse in direction from igloo to igloo. Each igloo has an axial bore hole 33 through its magnetic pole. The magnetic field orientation in each axial bore hole 33 is the reverse of that in the adjacent cavity and therefore a continually alternating magnetization along the particle beam path is fully realized. Comparing a field period of FIG. 3 with that of FIG. 2 it will be evident that the period to bore ratio is reduced by half; i.e., the period to bore ratio is reduced from eight (8) to four (4).

The relatively thin plates 32 of permeable material (e.g., iron) are much better heat conductors than the magnetic shells and these plates can, of course, extend beyond the periphery of the adjoining hemispheres. Thus, internal operating temperatures can be kept substantially lower than in the pearl string of spheres of FIG. 2. As a result, higher magnetic fields can be achieved, as well as better beam focusing, more efficient tube operation and longer tube life. Also, PPMs in accordance with the invention are easier to "tune" because they make the interiors more accessible to the effects of external shims. These and other advantages flowing from the structural arrangement of the present invention should be readily apparent to those skilled in this art.

The magnetic material of the segments of the magic hemispheres may be composed of $Nd_2Fe_{14}B$, $SmCo_5$, $PtCo_5$, $Sm_2(CoT)_{17}$ where T is one of the transition metals, and so on. The foregoing materials are characterized by the fact that they maintain their full magnetization in fields larger than their coercivities. These and other equivalent magnetic materials (e.g., selected ferrites) are known to those in the art. Accordingly, it is to be understood that the principles of the present invention are in no way limited to the magnetic material selected for the segments. Also, as known to those skilled in the art, the segments can be pressed to the appropriate shape(s) and magnetized in the desired orientation using any of the known magnetization techniques.

The high saturation, high permeability planar sheets 12, 32 may be comprised of iron, permandur, permalloy, etc. As is known to those skilled in the art, the plate must be thick enough to prevent saturation of the plate material. Stated somewhat differently, the flux in the cavity must not exceed an amount that will result in a value of B (flux density) in the anti-mirror material that is greater than its saturation value. Thus, there is an interrelationship between the desired cavity field and the plate thickness. For a flux density of about 20 KG a plate of iron should be at least 1 cm in thickness; for permandur a plate thickness of about 0.8 cm will suffice.

As pointed out in the above-cited co-pending application disclosing HSFS stacks, the pearl string of magic spheres can be field aligned (FIG. 2) or, alternatively, the magnetic field orientation in the central cavities can alternate or reverse in direction from sphere to sphere. In either case, the principles of the present invention are applicable; i.e., a significant reduction (half) in the period to bore ratio can be achieved.

Having shown and described what is at present considered to be a preferred embodiment of the invention, it should be understood that the same has been shown by way of illustration and not limitation. And, all modifications, alterations and changes coming within the spirit and scope of the invention are meant to be included herein.

What is claimed is:

1. A periodic permanent magnet structure comprising a plurality of aligned juxtaposed hollow hemispherical flux sources each of which produces a uniform high-field in its hemispherical central cavity, the magnetic field orientations in the central cavities being axially directed and successively alternating in direction from hemispherical source to hemispherical source, and an axial bore hole through the magnetic poles of the stack of hemispheric flux sources so as to form with said cavities a continuous channel through the stack through which a beam of charged particles can travel.

2. A periodic permanent magnet structure as defined in claim 1 wherein said stack comprises a plurality of pairs of hemispheric magnetic shells, each pair being mounted on opposite sides of a respective plate of permeable material so that the plate closes the open ends thereof, each magnetic shell forming with the contiguous plate a hollow hemispherical flux source, said bore hole extending through the magnetic poles of each pair of hemispheric magnetic shells and through each plate of permeable material, said plurality of pairs of magnetic shells being axially aligned and contiguous with adjacent pairs of magnetic shells.

3. A periodic permanent magnet structure as defined in claim 2 wherein the stack has a field period to bore hole ratio of substantially four-to-one.

4. A periodic permanent magnetic structure as defined in claim 3 wherein the hollow hemispherical flux sources are of the same dimensions, and the magnetic field orientation in each axial bore hole of each magnetic shell is the reverse of that in the adjacent cavity.

5. A periodic permanent magnet structure as defined in claim 4 wherein the plates of permeable material are at least peripherally coextensive with the hemispheric shells mounted thereon.

6. A periodic permanent magnet structure as defined in claim 5 wherein said plurality of hemispheric flux sources comprises at least eight in number.

7. A periodic permanent magnet structure as defined in claim 6 wherein the shell thickness of each hollow flux source is equal to the cavity radius of the same.

* * * * *